US007786397B2

(12) United States Patent
Dick

(10) Patent No.: US 7,786,397 B2
(45) Date of Patent: Aug. 31, 2010

(54) SAFETY TRIGGER GUARD

(75) Inventor: Roderick Dick, San Diego, CA (US)

(73) Assignee: Makita U.S.A., Inc., La Mirada, CA (US)

( * ) Notice: Subject to any disclaimer, the term of this patent is extended or adjusted under 35 U.S.C. 154(b) by 71 days.

(21) Appl. No.: 11/902,362

(22) Filed: Sep. 20, 2007

(65) Prior Publication Data

US 2008/0093203 A1 Apr. 24, 2008

Related U.S. Application Data

(60) Provisional application No. 60/845,779, filed on Sep. 20, 2006.

(51) Int. Cl.
*H01H 9/00* (2006.01)

(52) U.S. Cl. ..... 200/332.2; 200/522

(58) Field of Classification Search ..... 200/334, 200/522, 332.1, 332.2, 43.17, 61.85, 61.86; 7/167; 42/65, 66, 143, 104, 70.07, 74, 72; 89/1.42; 124/31, 32

See application file for complete search history.

(56) References Cited

U.S. PATENT DOCUMENTS

| | | | | |
|---|---|---|---|---|
| 2,270,707 | A * | 1/1942 | Humski | 42/111 |
| 3,142,126 | A * | 7/1964 | Rohm | 42/65 |
| 3,654,720 | A * | 4/1972 | Ruger | 42/75.01 |
| 3,899,845 | A * | 8/1975 | Wild et al. | 42/69.01 |
| 4,264,028 | A * | 4/1981 | Austin | 227/8 |
| 4,573,280 | A * | 3/1986 | Malhotra | 42/7 |
| 4,629,106 | A * | 12/1986 | Howard et al. | 227/8 |
| 5,161,679 | A * | 11/1992 | Russo | 200/43.17 |
| 5,180,091 | A * | 1/1993 | Ota | 227/8 |
| 5,406,731 | A * | 4/1995 | Stevens | 42/71.02 |
| 5,654,594 | A * | 8/1997 | Bjornsen et al. | 307/115 |
| 6,023,874 | A * | 2/2000 | Veit | 42/111 |
| 6,434,874 | B1 * | 8/2002 | Hines | 42/74 |
| 6,862,829 | B2 * | 3/2005 | McMoore | 42/70.07 |
| 6,908,021 | B1 * | 6/2005 | Wang | 227/8 |
| 2002/0170224 | A1 * | 11/2002 | Lawless | 42/71.02 |

* cited by examiner

*Primary Examiner*—Michael A Friedhofer
(74) *Attorney, Agent, or Firm*—Roylance, Abrams, Berdo & Goodman, L.L.P.

(57) ABSTRACT

Method and device are provided where a barrier is formed at or around the trigger of a device with a rest area for the index finger so that the finger can remain (extended) off the trigger when the device is not in use. Position and/or size of the rest area is adjustable to, for example, accommodate index fingers of various sizes. Adjustment of the position of the rest area can be achieved by means of a screw which slides a resting piece to a selected correct location, or by means of inserts that may be indexed to a selected length. Device can be a nailer, and the barrier is configured to accommodate a depth gage of the nailer.

27 Claims, 7 Drawing Sheets

SAFETY TRIGGER GUARD

This application claims benefit under 35 U.S.C. §119(e) from U.S. Provisional Patent Application Ser. No. 60/845,779 filed on Sep. 20, 2006, the entire contents of which is incorporated herein by reference.

TECHNICAL FIELD

The present invention is in the field of safety devices for power tools. In particular, the present invention provides a method and an apparatus for facilitating safe operation of a pneumatic nail gun by implementing a trigger guard.

BACKGROUND OF THE INVENTION

Conventional power tools, including pneumatic nail guns are designed with a trigger mechanism for actuating the operation of these tools.

Various implementations to prevent accidental triggering of such tools are known in the art. U.S. Pat. Nos. 6,908,021, 4,264,028 and 4,629,106, the entire disclosure of each of these patents is incorporated herein by reference, are in the related field, and disclose safety devices for trigger means in nail guns and fastener driving tools. These safety devices are constituted by locking mechanism which performs the function of preventing accidental triggering. On the other hand, U.S. Pat. No. 5,180,091, the entire disclosure of which is incorporated herein by reference, discloses a triggering mechanism 23 for actuation of trigger valve 9 which does not in itself perform the function, nor has the necessary structure, to prevent accidental triggering.

U.S. Pat. No. 5,161,679, the entire disclosure of which is incorporated herein by reference, discloses a safety feature for an electrical trigger switch which controls current through a pair of main leads. While this patent is not directly related to the field of framing guns, the structure of the trigger guard 26 disclosed therein, as shown for example in FIGS. 3 and 6 of the U.S. Pat. No. 5,161,679, when in closed ("guard") position resists physical pressure to move the trigger to an active position (see col. 1, lines 56-63; and col. 3, line 56-63) thereby facilitating prevention of accidental triggering.

Further, while not directly related to power tools, various trigger guard devices for fire arms are known, but do not necessarily lend themselves to obvious implementations in power tools.

Accordingly, there is a need for safety devices and methods for facilitating prevention of accidental triggering of power tools, that can be easily implemented in existing power tools and can provide convenience features specific to the power tool users.

SUMMARY OF THE INVENTION

The present invention provides a method and an apparatus to address at least the drawbacks noted above.

According to an exemplary embodiment of the present invention, a method and device are provided where a barrier is formed at or around the trigger of a device with a rest area for the index finger so that the finger can remain (extended) off the trigger when the device is not in use.

In yet another exemplary implementation, the position and/or size of the rest area is adjustable to, for example, accommodate index fingers of various sizes.

In an exemplary implementation, the adjustment of the position of the rest area is achieved by means including, but not limited to, a screw which slides a resting piece to a selected correct location.

In an exemplary implementation, the adjustment of the position of the rest area is achieved by means including, but not limited to, inserts that may be indexed to a selected length.

In an exemplary implementation the device is a nailer, and the barrier is configured to accommodate a depth gage of the nailer.

BRIEF DESCRIPTION OF THE DRAWINGS

The above and other objects, features and advantages of the present invention will become more apparent from the following detailed description when taken in conjunction with the accompanying drawings in which.

Throughout the drawings, the same drawing reference numerals will be understood to refer to the same elements, features, and structures.

DETAILED DESCRIPTION OF EXEMPLARY EMBODIMENTS

Certain exemplary embodiments of the present invention will now be described in greater detail with reference to the accompanying drawings.

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
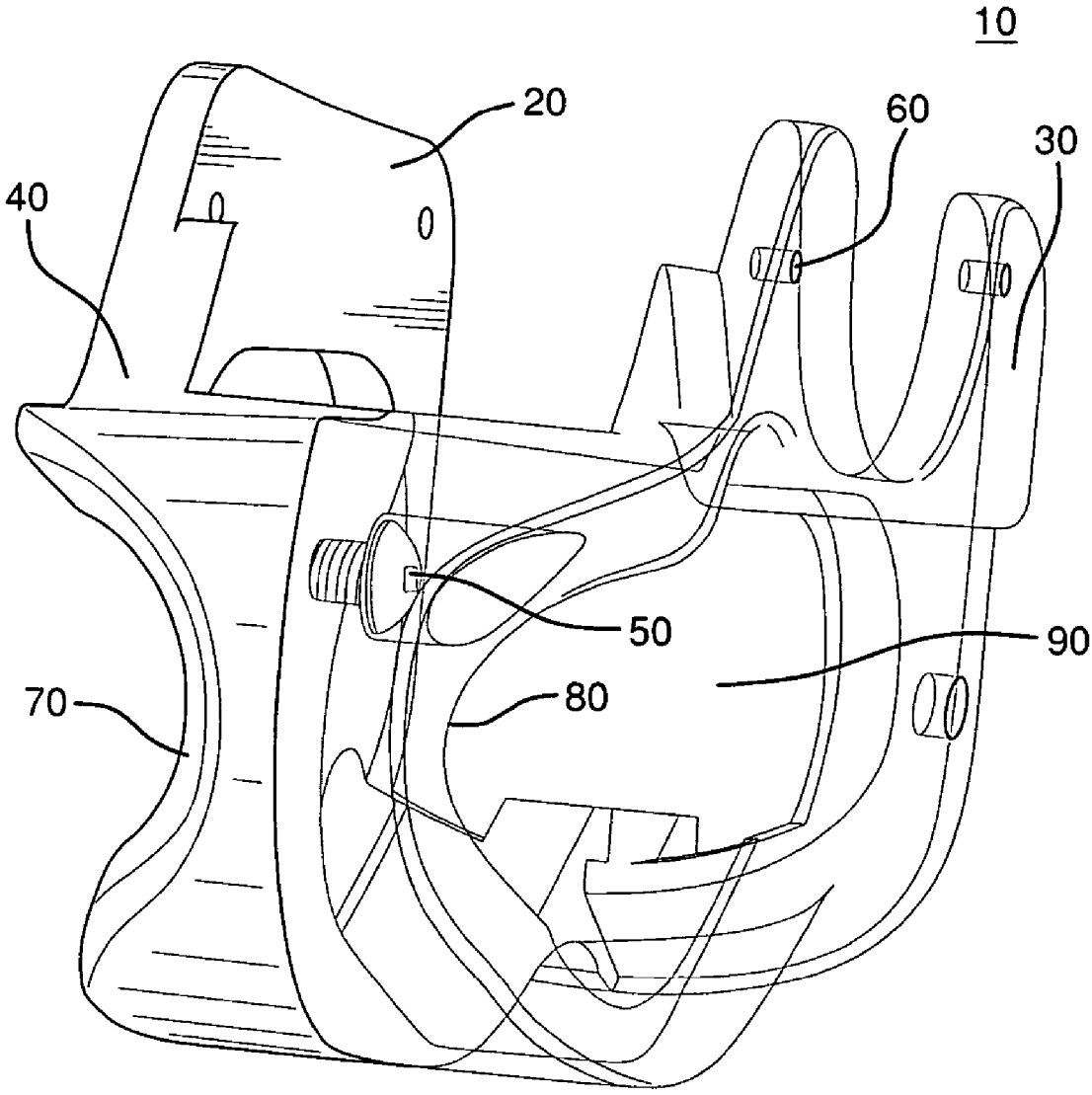
FIG. 1: illustrates a trigger guard according to an exemplary embodiment of the present invention.

Referring to FIG. 1, a safety trigger guard 10 according to an exemplary embodiments of the invention is illustrated as comprising two portions 20 and 30, which can be implemented as a single unit held together by fastening means such as a screw 50, or as separate right-handed and left-handed units as will be described below.

Figure 3:
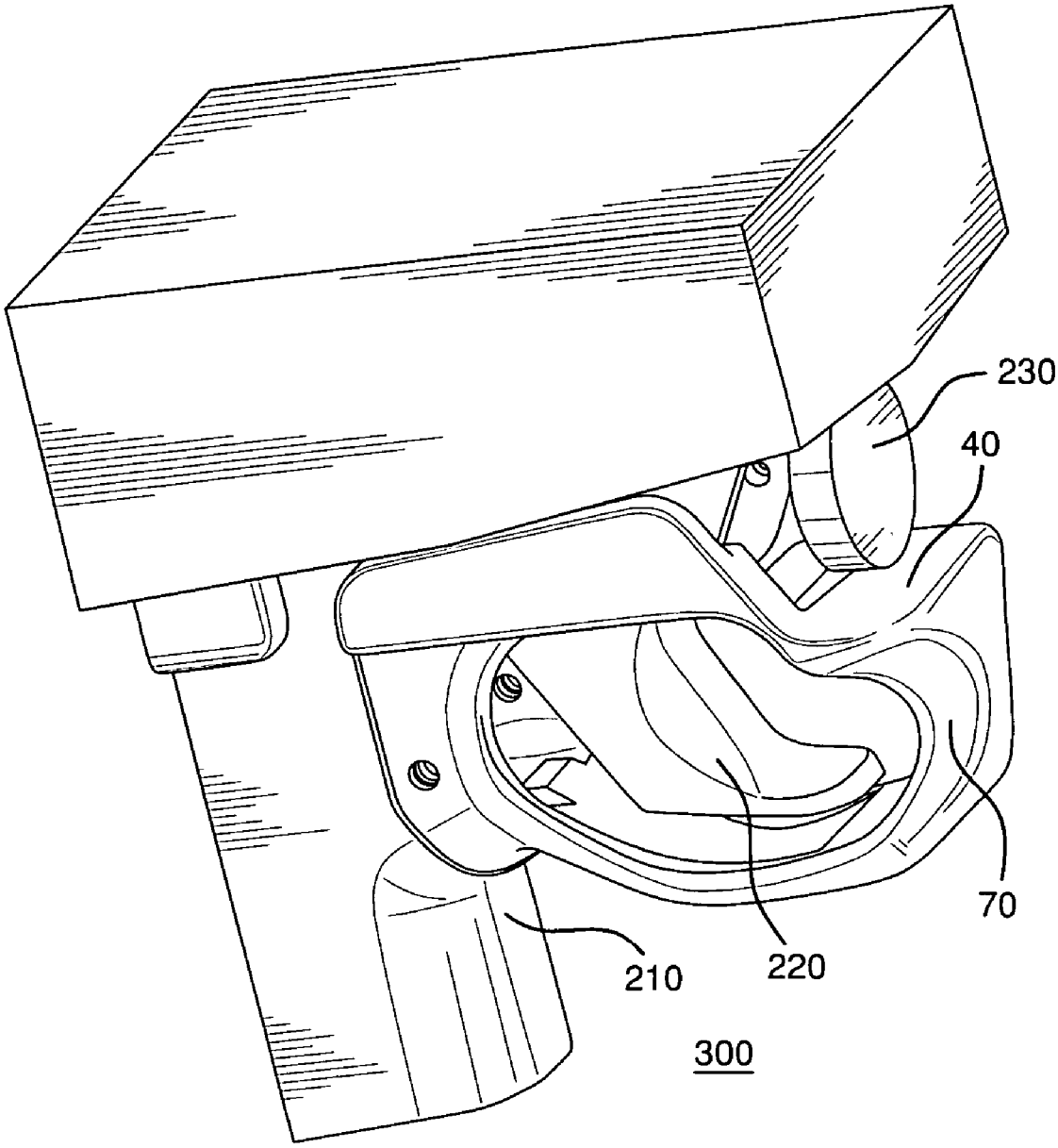
FIG. 3: illustrates a trigger guard according to another exemplary embodiment of the present invention.
Figure 4:
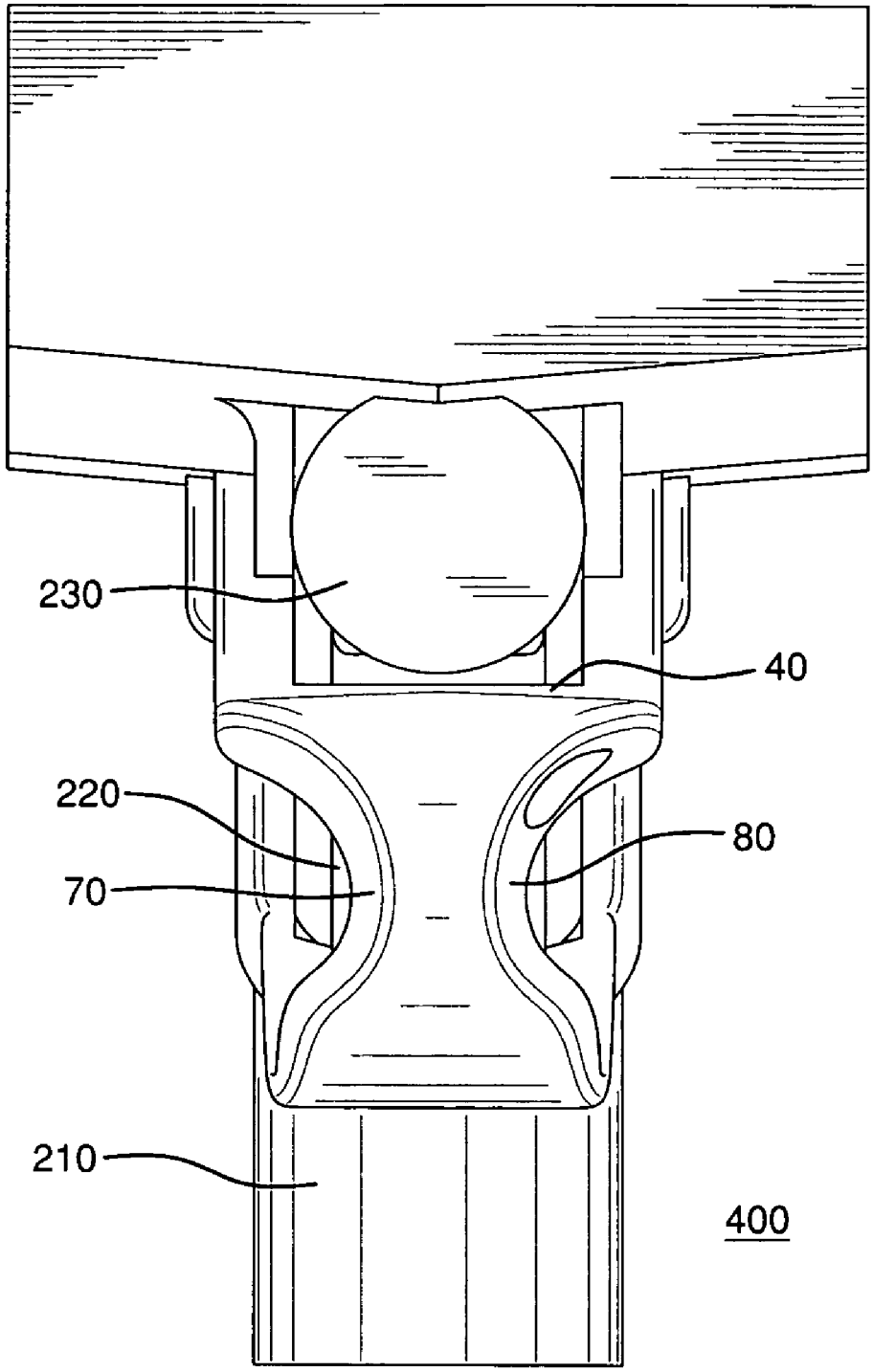
FIG. 4: is a front view of a trigger guard according to an exemplary embodiment of the present invention as illustrated in FIG. 1.
Figure 5:
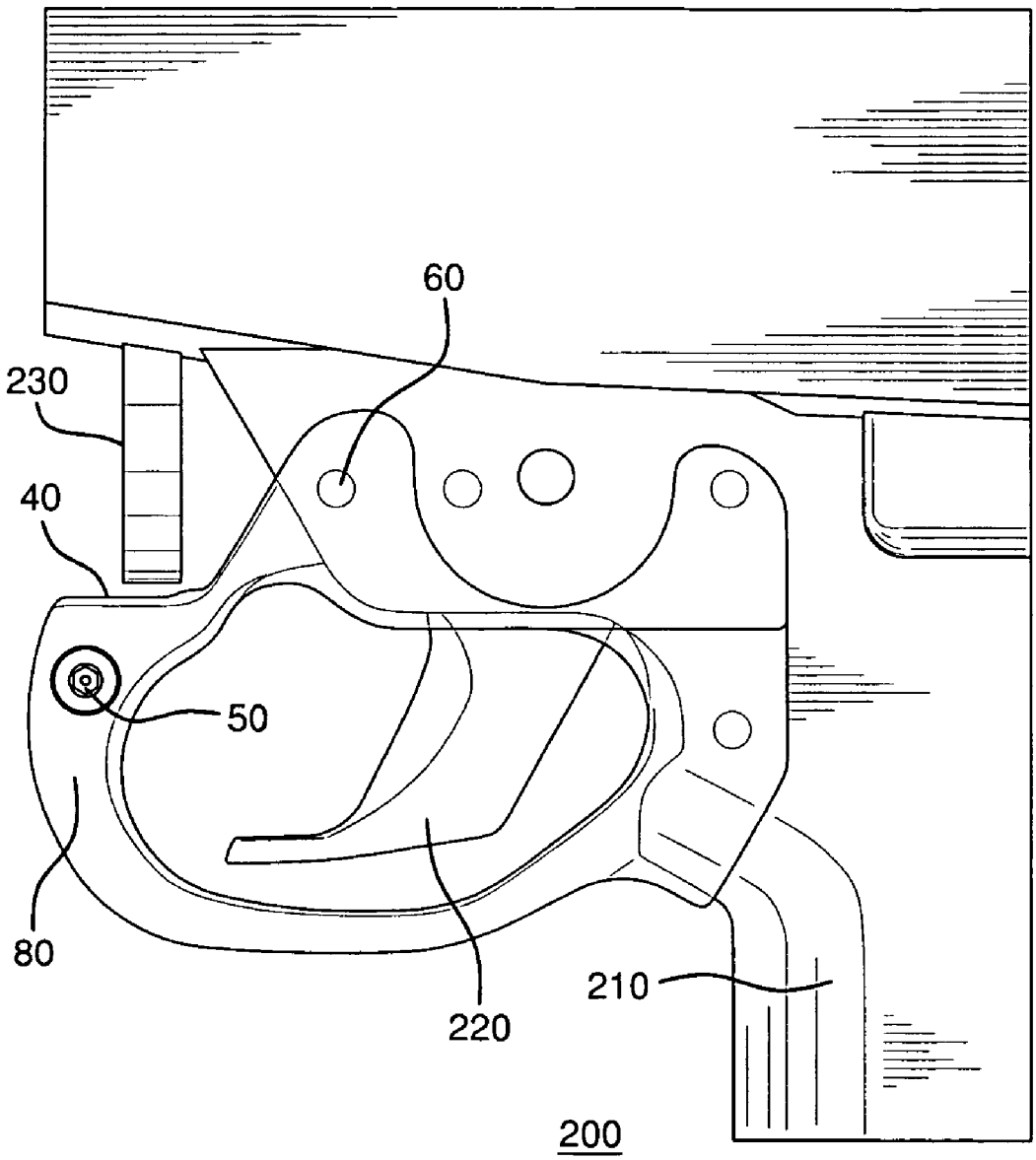
FIG. 5: is a side view of a trigger guard according to an exemplary embodiment of the present invention as illustrated in FIG. 2.

According to an exemplary embodiment of the present invention, trigger guard 10 comprises finger rest areas 70 and 80, an indent 40 for accommodating, for example a depth gage of a nailer (as shown in FIGS. 2-7), an opening 90 for accommodating a trigger (as shown in FIGS. 2-7) and attachment means 60 for attaching to a body of a tool as shown, for example in FIG. 5.

Figure 2:
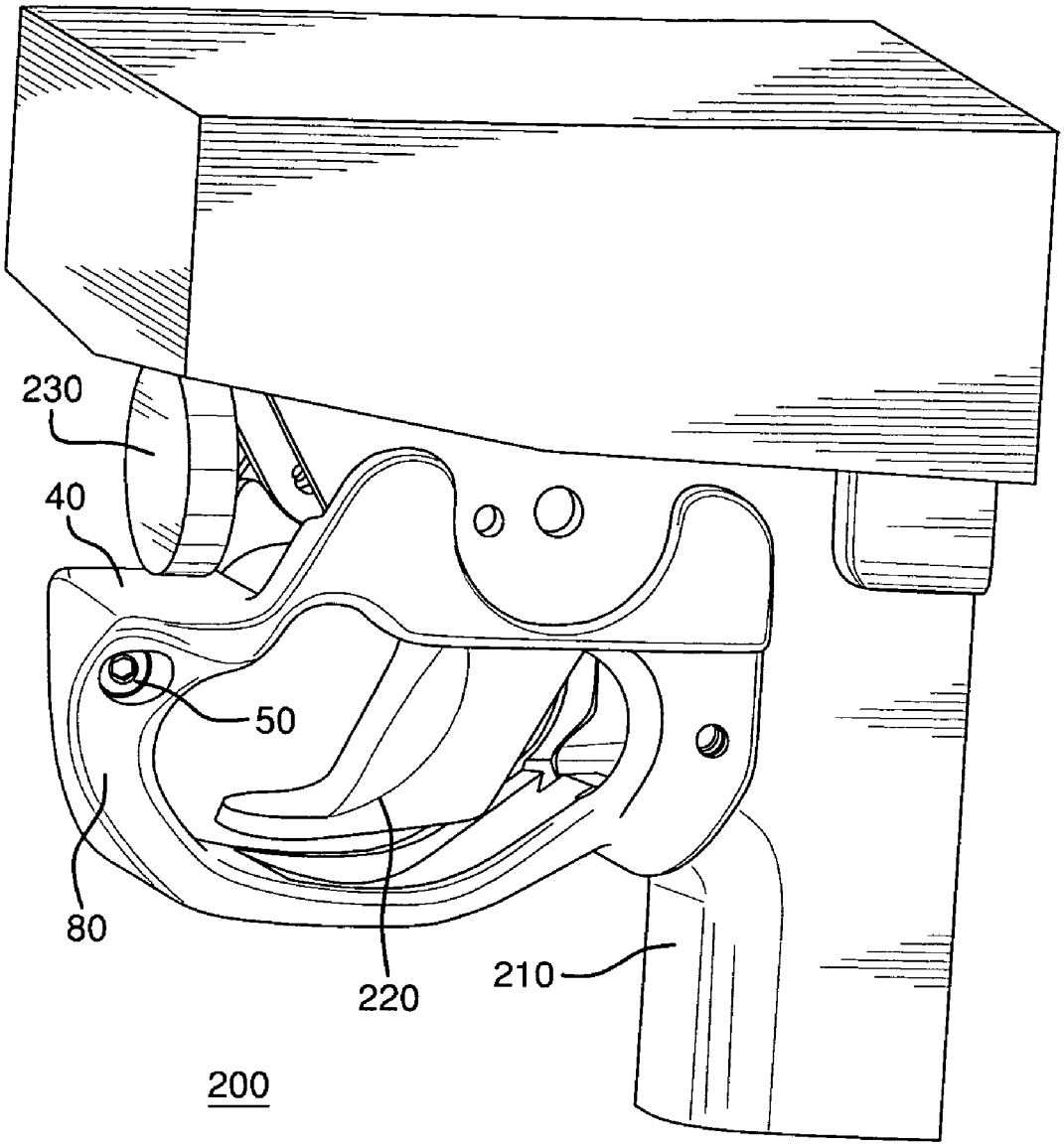
FIG. 2: illustrates a trigger guard according to another exemplary embodiment of the present invention.

Referring to FIGS. 2 and 5, a safety trigger guard 200 according to an exemplary embodiments of the invention is implemented as a single left-handed unit attached to the body of tool 210, in which case screw 50, shown here for illustrative purposes, can be omitted. As further shown in FIGS. 2 and 5, indent 60 trigger guard 200 accommodates depth gage 230 of tool 210, and opening 90 accommodates trigger 220. FIG. 5 also shows an exemplary configuration of attachment means 60.

Figure 6:
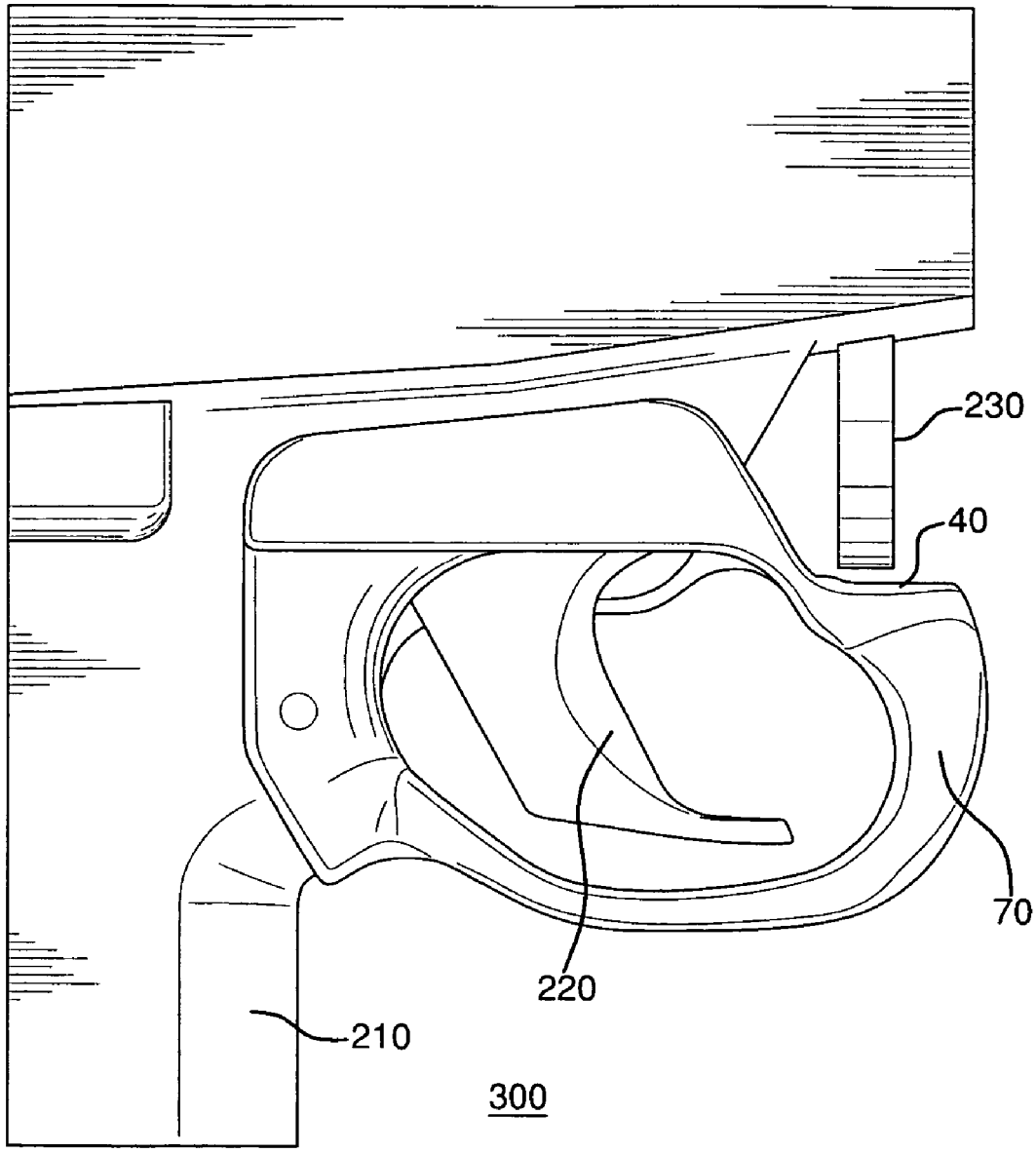
FIG. 6: is a side view of a trigger guard according to an exemplary embodiment of the present invention as illustrated in FIG. 3.

Referring to FIGS. 3 and 6, a safety trigger guard 300 according to an exemplary embodiment of the invention is implemented as a single right-handed unit attached to the body of tool 210, as shown here, screw 50 is omitted. Likewise, as further shown in FIGS. 3 and 6, indent 60 trigger guard 200 accommodates depth gage 230 of tool 210, and opening 90 accommodates trigger 220.

FIG. 4 is an exemplary implementation of a device 400 (front view) which includes a trigger guard of FIG. 1.

Figure 7:
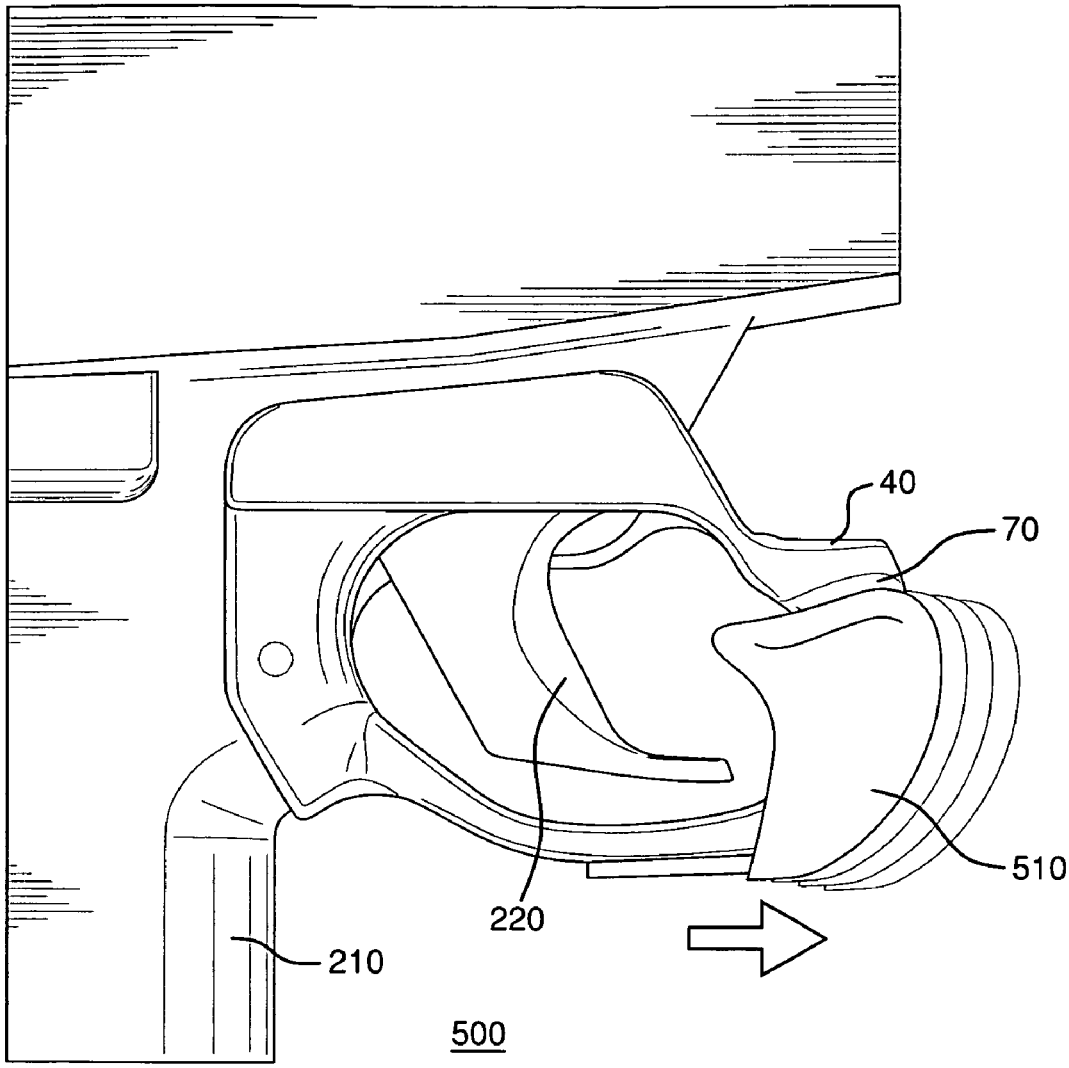
FIG. 7: illustrates a trigger guard according to another exemplary embodiment of the present invention.

FIG. 7 illustrates an exemplary implementation of a trigger guard 500, rest area 70 comprises a resting piece 510 for extending and/or varying the finger rest area according to an embodiment of the present invention. As shown by an arrow in FIG. 7, the position of the resting piece 510 is adjustable to, for example, accommodate index fingers of various sizes. The size of the resting piece 510 can also vary.

In an exemplary implementation, the adjustment of the position of the rest area is achieved by means including, but not limited to, a screw (not shown) which slides the resting piece 510 with respect to rest area 70 to a selected correct location.

In an exemplary implementation, the adjustment of the position of the rest area is achieved by means including, but not limited to, inserts that may be indexed to a selected length.

In an exemplary implementation device 400 is a nailer, and the barrier is configured to accommodate a depth gage of the nailer.

Although several embodiments of the present invention have been disclosed for illustrative purposes, those skilled in the art will appreciate that various modifications, additions and substitutions are possible, without departing from the scope of the invention. Accordingly, the present invention is not limited to the above-described embodiments.

What is claimed is:

1. A safety device comprising:

a barrier formed to accommodate a trigger in an interior opening thereof;

a rest area formed on at least one surface of said barrier, said rest area comprising a shape for accommodating an extended human finger;

a resting piece selectively positioned with respect to said rest area; and means for attaching said barrier to a device comprising said trigger.

2. The safety device of claim 1, wherein the extended human finger is a trigger finger that operates said trigger.

3. The safety device of claim 1, wherein said resting piece is slideably positioned with respect to said rest area.

4. The safety device of claim 3, further comprising a fastener for attaching said resting piece to said rest area.

5. The safety device of claim 4, wherein said fastener comprises a screw.

6. The safety device of claim 1, wherein said resting piece comprises at least one insert for varying said rest area.

7. A method for preventing accidental triggering of a device actuatable by means of a trigger, the method comprising:

forming a barrier to accommodate a trigger in an interior opening thereof;

forming a rest area on at least one surface of said barrier, said rest area comprising a shape for accommodating an extended human finger;

attaching said barrier to a device comprising said trigger; and selectively positioning a resting piece with respect to said rest area.

8. The method of claim 7, wherein the extended human finger is a trigger finger that operates said trigger.

9. The method of claim 7, wherein said selectively positioning of said resting piece comprises slideably positioning said resting piece with respect to said rest area.

10. The method of claim 9, further comprising fixedly attaching said resting piece to said rest area.

11. The method of claim 10, wherein said fixedly attaching said resting piece comprises attaching said resting piece to said rest area with a screw.

12. The method of claim 7, wherein said resting piece comprises at least one insert, said method further comprising vary said rest area by selectively positioning said at least one insert with respect to said rest area.

13. A safety device comprising:

a barrier formed to accommodate a trigger in an interior opening thereof;

a rest area formed on at least one surface of said barrier, said rest area comprising a shape for accommodating an extended human finger; and means for attaching said barrier to a device comprising said trigger, wherein said barrier comprises an indent for accommodating a controller of said device, said controller being disposed closer to said trigger than an outer perimeter of said barrier.

14. A safety device comprising:

a barrier formed to accommodate a trigger in an interior opening thereof, said barrier being attachable to a device comprising said trigger;

a rest area formed on at least one surface of said barrier, said rest area comprising a shape for accommodating an extended human finger; and a resting piece selectively positioned with respect to said rest area.

15. The safety device of claim 14, wherein the extended human finger is a trigger finger that operates said trigger.

16. The safety device of claim 14, wherein said resting piece is slideably positioned with respect to said rest area.

17. The safety device of claim 16, further comprising a fastener for attaching said resting piece to said rest area.

18. The safety device of claim 17, wherein said fastener comprises a screw.

19. The safety device of claim 14, wherein said resting piece comprises at least one insert for varying said rest area.

20. A method for preventing accidental triggering of a device actuatable by means of a trigger, the method comprising:

forming a barrier to accommodate a trigger in an interior opening thereof;

forming a rest area on at least one surface of said barrier, said rest area comprising a shape for accommodating an extended human finger;

attaching said barrier to a device comprising said trigger; and forming an indent in said barrier for accommodating a controller of said device, said controller being disposed closer to said trigger than an outer perimeter of said barrier.

21. A safety device comprising:

a barrier formed to accommodate a trigger in an interior opening thereof, said barrier being attachable to a device comprising said trigger; and a rest area formed on at least one surface of said barrier, said rest area comprising a shape for accommodating an extended human finger;

wherein said barrier comprises an indent for accommodating a controller of said device, said controller being disposed closer to said trigger than an outer perimeter of said barrier.

22. The safety device of claim 21, wherein the extended human finger is a trigger finger that operates said trigger.

23. The safety device of claim 21, further comprising a resting piece selectively positioned with respect to said rest area.

24. The safety device of claim 23, wherein said resting piece is slideably positioned with respect to said rest area.

25. The safety device of claim 24, further comprising a fastener for attaching said resting piece to said rest area.

26. The safety device of claim 25, wherein said fastener comprises a screw.

27. The safety device of claim 23, wherein said resting piece comprises at least one insert for varying said rest area.

* * * * *